US006773080B2

(12) United States Patent
Chen et al.

(10) Patent No.: US 6,773,080 B2
(45) Date of Patent: Aug. 10, 2004

(54) BRACKET DEVICE FOR A TRACK ASSEMBLY

(75) Inventors: Ken-Ching Chen, Kaohsiung Hsien (TW); I-Ming Tseng, Kaohsiung Hsien (TW); Chun-Chiang Wang, Kaohsiung Hsien (TW)

(73) Assignee: King Slide Works, Co., Ltd. (TW)

( * ) Notice: Subject to any disclaimer, the term of this patent is extended or adjusted under 35 U.S.C. 154(b) by 0 days.

(21) Appl. No.: 10/310,877

(22) Filed: Dec. 6, 2002

(65) Prior Publication Data

US 2004/0108427 A1 Jun. 10, 2004

(51) Int. Cl.[7] ..... A47G 29/00

(52) U.S. Cl. ..... 312/265.1; 312/265.4; 312/334.4; 248/244; 248/220.22; 248/219.1; 211/26

(58) Field of Search ..... 248/244, 243, 248/219.1, 220.22, 220.31, 221.11, 222.11, 225.21; 312/265.1, 265.4, 334.4, 334.5; 211/191, 192, 182, 26; 361/683

(56) References Cited

U.S. PATENT DOCUMENTS 4,671,481 A * 6/1987 Beard ..... 248/222.13
4,733,841 A * 3/1988 Wilson ..... 248/222.13
4,971,281 A * 11/1990 Steinbeck ..... 248/222.13
5,535,972 A * 7/1996 Fallago ..... 248/220.22
5,538,213 A * 7/1996 Brown ..... 248/222.11
5,833,337 A * 11/1998 Kofstad ..... 312/334.5
6,273,534 B1 * 8/2001 Bueley et al. ..... 312/334.8
6,312,069 B1 * 11/2001 Weng ..... 312/312
6,422,399 B1 * 7/2002 Castillo et al. ..... 211/26
6,523,918 B1 * 2/2003 Baiza ..... 312/265.1
6,554,142 B2 * 4/2003 Gray ..... 211/26
6,578,939 B1 * 6/2003 Mayer ..... 312/334.5
2001/0040203 A1 * 11/2001 Brock et al. ..... 248/222.11
2003/0106863 A1 * 6/2003 Lauchner et al. ..... 211/26

* cited by examiner

*Primary Examiner*—Leslie A. Braun
*Assistant Examiner*—Naschica S. Morrison
(74) *Attorney, Agent, or Firm*—Bacon & Thomas, PLLC

(57) ABSTRACT

A bracket device for a track assembly. The bracket device includes a bracket member, a latch member and a retaining member. The bracket member includes a hook extended therefrom and adapted to connect with an assembling hole of a rack. The latch member includes a stop extended therefrom and movably received in a slot of the bracket member. The retaining member includes an engaging portion adapted to engage/disengage with/from an engaging portion of the latch member.

8 Claims, 5 Drawing Sheets

BRACKET DEVICE FOR A TRACK ASSEMBLY

BACKGROUND OF THE INVENTION

1. Field of the Invention

The present invention is related to a bracket device for a track assembly and more particularly to the bracket device having a retaining member adapted to combine the track assembly with a rack or a cabinet.

2. Description of the Related Art

A conventional track assembly, combined with a drawer, is mounted to a wall or a frame of a cabinet by fixing members. It is complicated and a prolonged an assembling process to disassemble the track assembly from the cabinet and to reassemble the track assembly by screwing or releasing a large number of the fixing members.

The present invention intends to provide a bracket device for a track assembly simplifying an assembling process on a rack or a cabinet in such a way to mitigate and overcome the above problem.

SUMMARY OF THE INVENTION

The primary objective of this invention is to provide a bracket device for a track assembly simplifying an assembling process on a rack or a cabinet.

The bracket device for a track assembly of the present invention mainly comprises a bracket member, a latch member and a retaining member. The bracket member includes a hook extended therefrom adapted to connect with an assembling hole of a rack. The latch member includes a stop extended therefrom and movably received in a slot of the bracket member. The retaining member includes an engaging portion adapted to engage/disengage with/from an engaging portion of the latch member.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
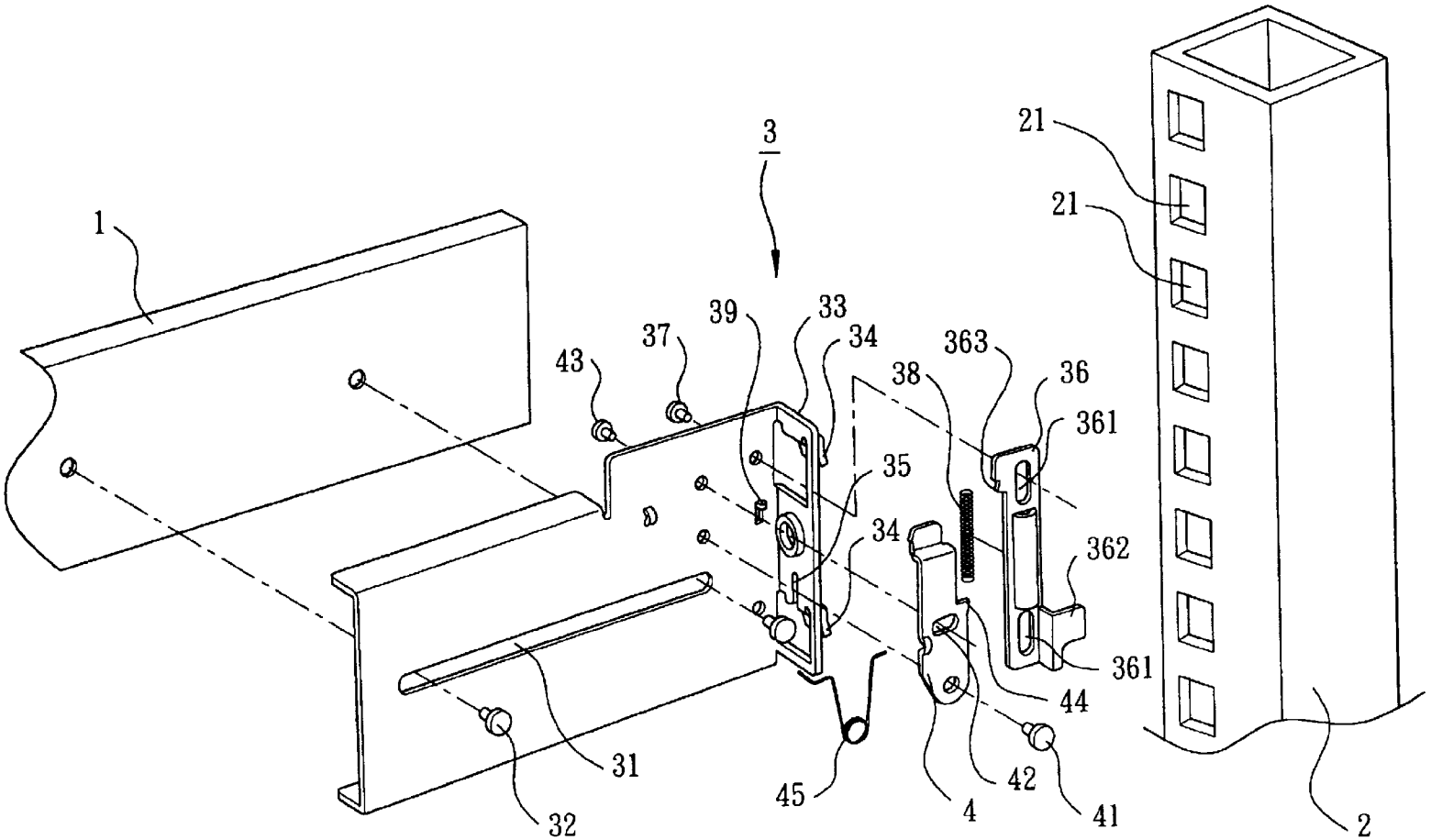
FIG. 1 is an exploded perspective view of a bracket device for a track assembly in accordance with an embodiment of the present invention.

Referring initially to FIG. 1, a bracket device in accordance with the embodiment of the present invention is used to connect a track assembly (a first portion) 1 to a rack (a second portion) 2. The bracket device 3 mainly includes a bracket member 33, a latch member 36 and a retaining member 4 combined as a mechanism.

The bracket device 3 is generally connected with an end of the track assembly 1 and a plurality of assembling holes 21 of the rack 2.

Referring again to FIG. 1, the bracket device 3 includes a slot 31 and a plurality of fixing members 32 extended therethrough for mounting to the track assembly 1 so that the bracket device 3 is capable of adjusting a relative assembling position on the track assembly 1.

The bracket device 3 further includes a bent wall (bracket member 33) located at its end, a pair of hooks 34 and a guiding slot 35 formed by pressing manner. The hooks 34 are adapted to connect to a bottom edge of the assembling hole 21 of the rack 2. The latch member 36 includes positioning slots 361 each receiving a fixing member 37 for limiting a relative movement on the bracket member 33, and a stop 362 adapted to extend into the guiding slot 35 of the bracket device 3 and the assembling hole 21 of the rack 2. A first elastic member 38 is contained between the latch member 36 and the bracket member 33 for permitting reciprocation therebetween. An end of the first elastic member 38 is adapted to confront with a protrusion 39 of the bracket member 33 while the other end confronts with the latch member 36. Moreover, the latch member 36 further includes an engaging portion 363 adapted to engage with an engaging portion 44 of the retaining member 4 for limiting any movement of the stop 362 in the assembling hole 21.

Figure 2:
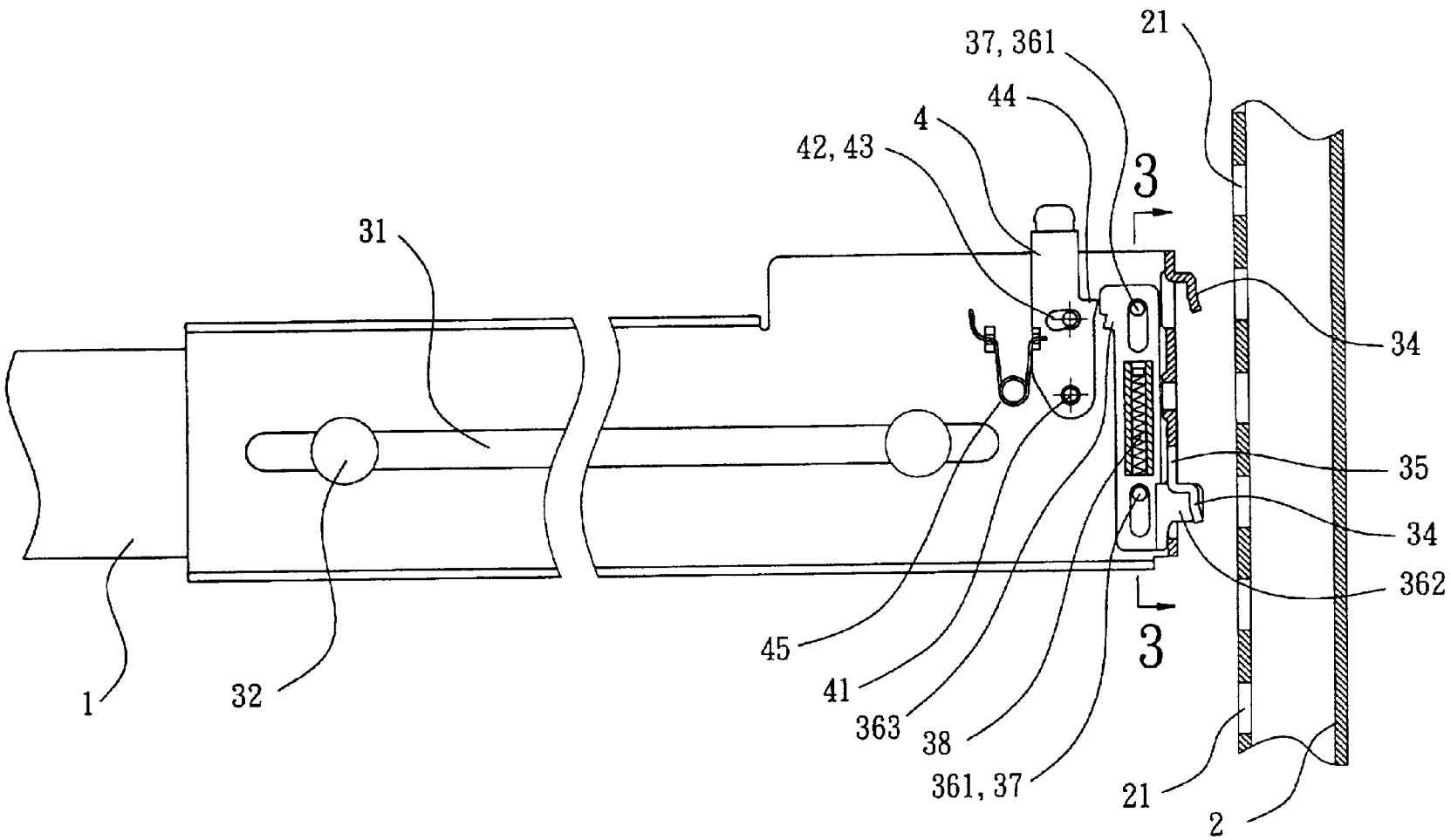
FIG. 2 is a partial cross-sectional view of the bracket device for the track assembly in accordance with the embodiment of the present invention.

Referring to FIGS. 1 and 2, the retaining member 4 is pivotally connected to the bracket member 33 by a fixing member 41. The retaining member 4 further includes a slot 42 and a limit member 43 extended therethrough. Accordingly, a relative angular movement of the retaining member 4 is limited within a predetermined angle. A second elastic member 45 is located between the bracket member 33 and the retaining member 4 for biasing purpose. An end of the second elastic member 45 is adapted to connect to the bracket member 33 while the other end connects to the retaining member 4.

Figure 3:
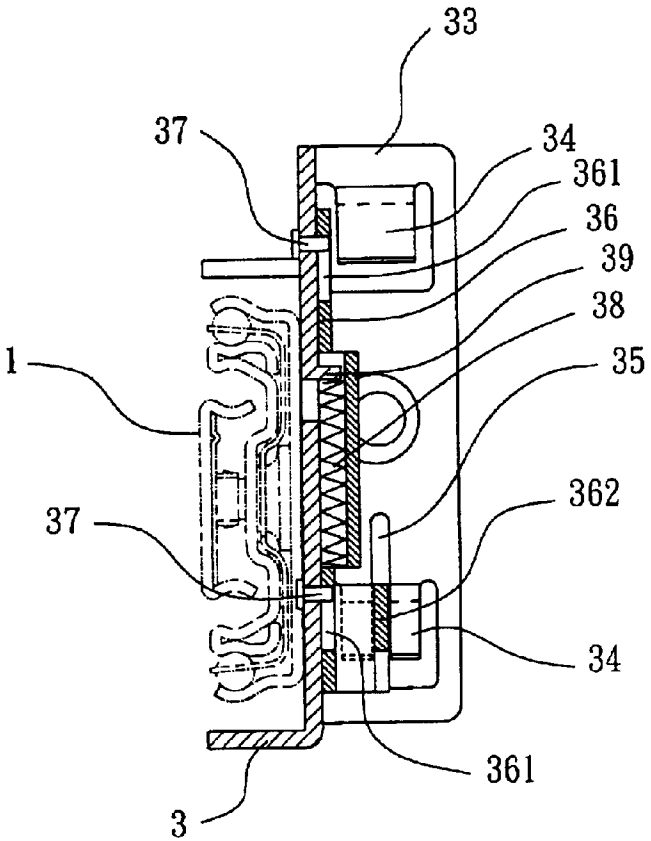
FIG. 3 is a cross-sectional view in FIG. 2 of the bracket device for the track assembly in accordance with the embodiment of the invention.

Referring to FIGS. 2 and 3, when the first elastic member 38 biases the latch member 36 in a pre-assembling situation, the stop 362 is released from the guiding slot 35 by biasing of the first elastic member 38. Meanwhile, the engaging portion 44 of the retaining member 4 is disengaged from the engaging portion 363 of the latch member 36.

Figure 5:
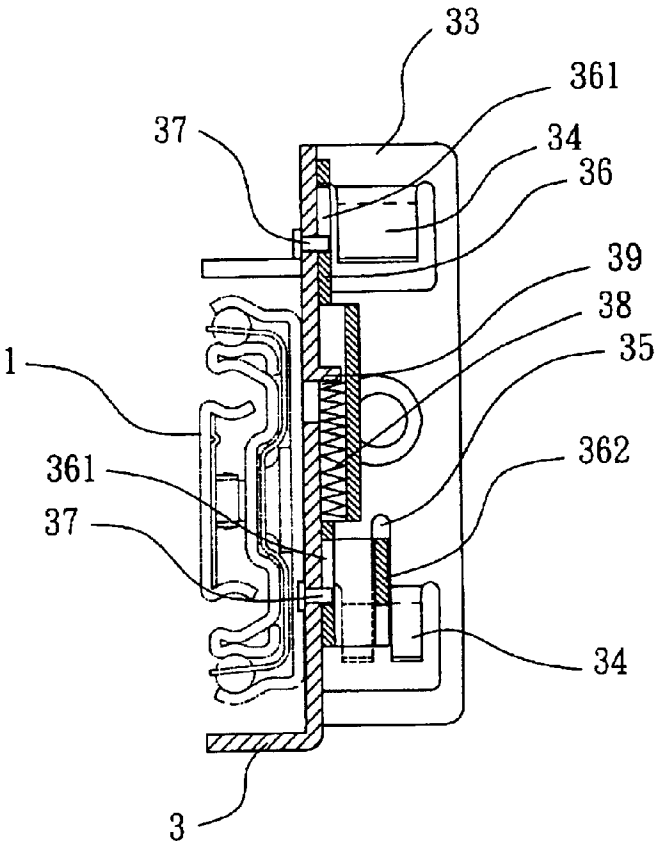
FIG. 5 is a cross-sectional view in FIG. 4 of the bracket device for the track assembly in accordance with the embodiment of the invention.
Figure 4:
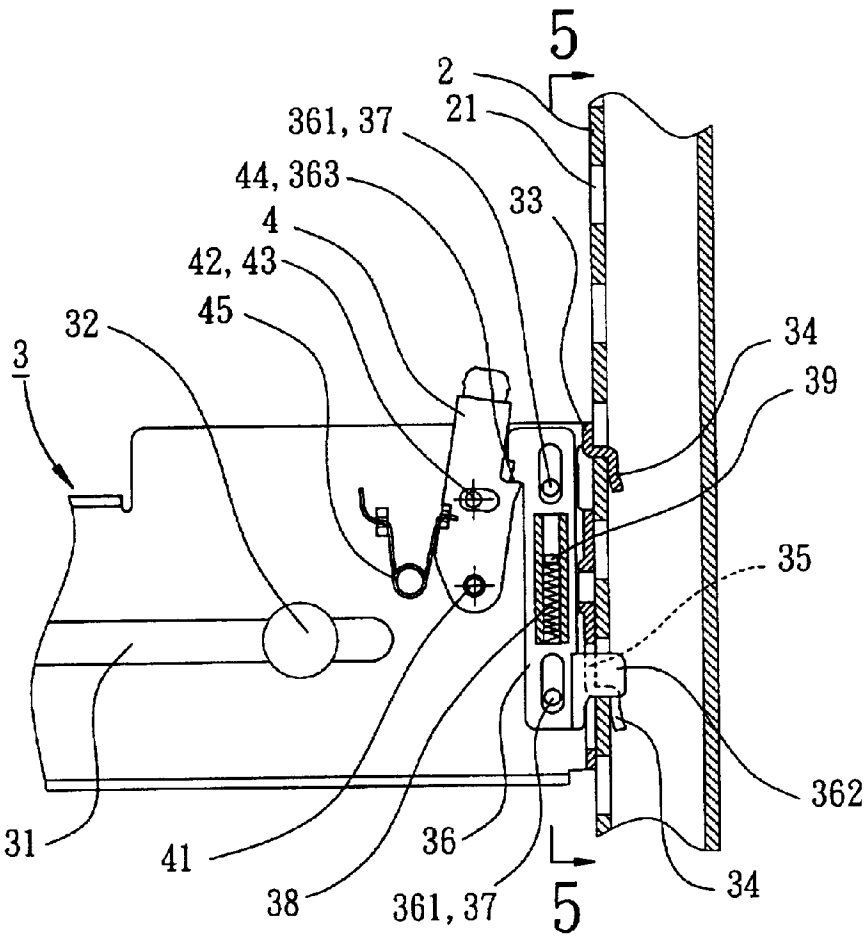
FIG. 4 is a partial cross-sectional view of the bracket device for the track assembly in accordance with the embodiment of the present invention, showing an initial assembled relationship of the bracket device and a rack.

Referring to FIGS. 4 and 5, combining with the track assembly 1, the bracket device 3 connects to the rack 2 in an assembling operation. When the hook 34 of the bracket member 33 is pressed downward in the assembling hole 21 of the rack 2, the latch member 36 is moved upward. Synchronously, the stop 362 is extended into the assembling hole 21 and confined within the guiding slot 35. Biased by the second elastic member 45, the retaining member 4 is engaged with the latch member 36. Consequently, the bracket device 3 combined with the track assembly 1 is completely connected to the rack 2.

Figure 6:
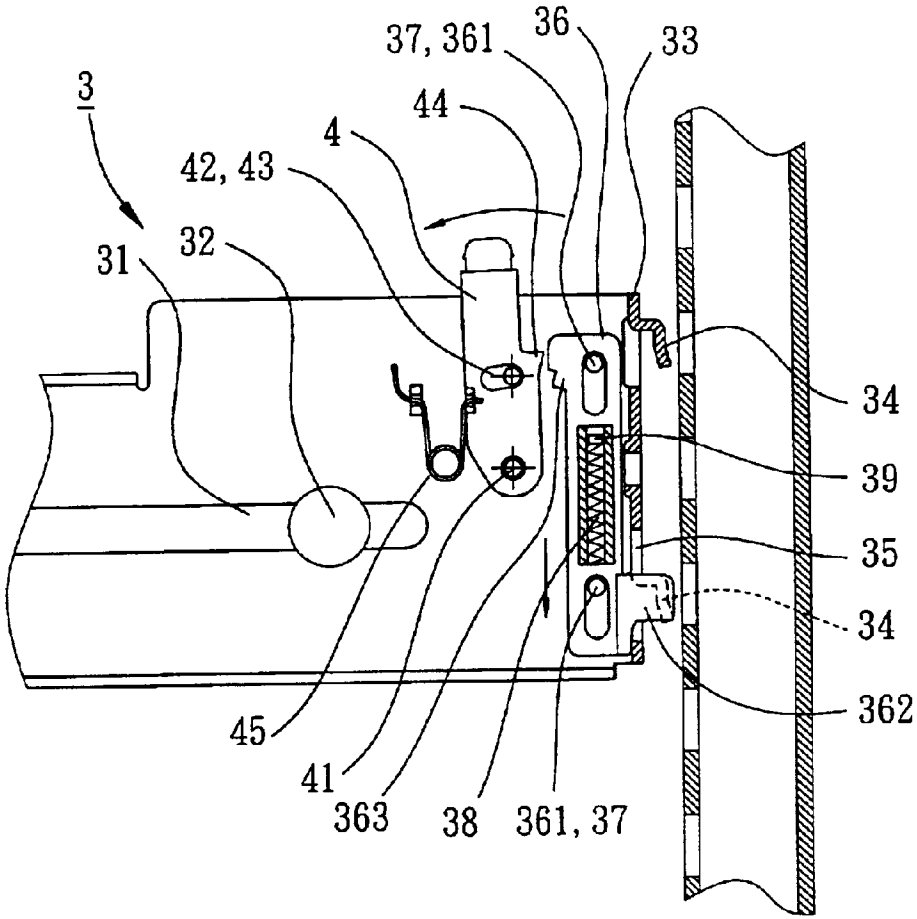
FIG. 6 is a partial cross-sectional view of the bracket device for the track assembly in accordance with the embodiment of the present invention, showing a released relationship of the bracket device from the rack.

Referring to FIG. 6, when users push the retaining member 4 in a disassembling operation, the engaging portion 44 of the retaining member 4 is disengaged from the engaging member 363 of the latch member 36. Once the latch member 36 is released, the hook 362 is released from the assembling hole 21 by biasing of the first elastic member 38. Consequently, the bracket device 3 is completely released from the rack 2.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A bracket device connected between a first portion and a second portion, comprising:

a bracket member mounted to the first portion, the bracket member including a hook adapted to connect with an assembling hole of the second portion;

a latch member including a stop movably received in a guiding slot of the bracket member and extended into the assembling hole of the second portion such that the stop of said latch member limits a removal movement of the hook of said bracket member from the second portion, and a first engaging portion;

a retaining member being pivotally connected to the bracket member, the retaining member including a second engaging portion adapted to engage with or disengage from the first engaging portion;

wherein the second engaging portion of said retaining member is engaged with the first engaging portion of said latch member for locking the latch member; and wherein a pivotal movement of the retaining member causes disengagement of the second engaging portion of said retaining member from the first engaging portion of said latch member for unlocking said latch member.

2. The bracket device as claimed in claim 1, wherein the first portion is a track assembly.

3. The bracket device as claimed in claim 1, wherein the second portion is a rack.

4. The bracket device as claimed in claim 1, wherein the bracket member further includes a slot and a fixing member extended therethrough for mounting to the first portion so that the bracket member is capable of adjusting a relative assembling position on the first portion.

5. The bracket device as claimed in claim 1, wherein the latch member further includes a positioning slot and a fixing member extended therethrough for limiting a relative movement on the bracket member.

6. The bracket device as claimed in claim 1, further comprising an elastic member being located between the bracket member and the latch member, a first end of the elastic member connects to a protrusion of the bracket member while a second end of the elastic member connecting to the latch member.

7. The bracket device as claimed in claim 1, wherein the retaining member further includes a slot and a limit member extended therethrough for limiting a relative angular movement of the retaining member within a predetermined angle.

8. The bracket device as claimed in claim 1, further comprising an elastic member being located between the bracket member and the retaining member, the elastic member providing with a bias force for engaging the second engaging portion with the first engaging portion.

* * * * *